US007997668B2

(12) United States Patent
Lee

(10) Patent No.: US 7,997,668 B2
(45) Date of Patent: Aug. 16, 2011

(54) REFRIGERATOR AND ASSEMBLING METHOD THEREOF

(75) Inventor: Chang Lim Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 471 days.

(21) Appl. No.: 12/142,628

(22) Filed: Jun. 19, 2008

(65) Prior Publication Data

US 2008/0314067 A1 Dec. 25, 2008

(30) Foreign Application Priority Data

Jun. 22, 2007 (KR) ..... 10-2007-0061539

(51) Int. Cl.
*A47B 96/04* (2006.01)

(52) U.S. Cl. ..... 312/402; 312/404; 312/331; 312/334.7

(58) Field of Classification Search ..... 312/402, 312/404, 408, 333, 334.44, 334.46–334.47, 312/331, 334.7–334.8; 62/402, 382
See application file for complete search history.

(56) References Cited

U.S. PATENT DOCUMENTS 6,478,393 B2 * 11/2002 Kim et al. ..... 312/334.12
6,565,170 B2 * 5/2003 Banicevic et al. ..... 312/404
7,108,339 B2 * 9/2006 Berger ..... 312/333
7,296,863 B2 * 11/2007 Lam et al. ..... 312/334.6
7,380,410 B2 * 6/2008 Rand et al. ..... 62/302
7,387,351 B2 * 6/2008 Nam ..... 312/402
7,594,707 B2 * 9/2009 Kunkle et al. ..... 312/402
2003/0173882 A1 * 9/2003 Koons ..... 312/404
2004/0000850 A1 * 1/2004 Lam Harn et al. ..... 312/333
2004/0000851 A1 * 1/2004 Lam Harn et al. ..... 312/334.7
2005/0160854 A1 * 7/2005 Rotter ..... 74/422
2006/0033410 A1 * 2/2006 Koons ..... 312/404

* cited by examiner

*Primary Examiner* — Hanh V Tran
(74) *Attorney, Agent, or Firm* — Birch, Stewart, Kolasch & Birch, LLP

(57) ABSTRACT

Provided are a refrigerator and an assembling method thereof that enable a storage member provided in a drawer-type storage space to be securely withdrawn and inserted, that improve the external appearance of a storage member when withdrawn and inserted, and that allow easier assembly and installation of the refrigerator. The refrigerator includes a main body provided with a storage space, a storage member in the main body and capable of being withdrawn and inserted, an extendable rail member between the storage member and the main body to guide withdrawal and insertion of the storage member, and a cover member at one side of the rail member to cover the rail member. Thus, external appearance is improved, as is assembling convenience.

19 Claims, 11 Drawing Sheets

-Prior Art-

REFRIGERATOR AND ASSEMBLING METHOD THEREOF

CROSS-REFERENCE TO RELATED APPLICATIONS

The present application claims priority under 35 U.S.C. 119 and 35 U.S.C. 365 to Korean Patent Application No. 10-2007-0061539(filed on 22 Jun., 2007), which is hereby incorporated by reference in its entirety.

BACKGROUND

The present disclosure relates to a refrigerator and an assembling method thereof that enable a storage member provided in a drawer-type storage space to be securely withdrawn and inserted, that improve the external appearance of a storage member when withdrawn and inserted, and that allow the refrigerator to be more easily assembled and installed.

In general, a refrigerator is a home appliance that can store foods at low temperatures within storage compartments that can be opened and sealed by refrigerator doors. Refrigerators employ cold air, generated through heat exchange with refrigerant that circulates in a refrigeration cycle, to cool the insides of storage compartments and store foods in optimal states.

Due to changes in eating habits and increasingly discriminating tastes, refrigerators are increasing in size, becoming more multi-functioned, and being diversified in various configurations centering on user convenience.

Of the various configurations of refrigerators, a bottom freezer refrigerator vertically partitions refrigeration and freezer compartments, with the freezer compartment disposed at the bottom. Among bottom freezer refrigerators, French door type refrigerators, with doors that open on the left and right of the refrigeration compartment, are strongly favored.

In a French door-type refrigerator, the storage space of the freezer compartment is configured as a drawer, which will be described in detail below with reference to the drawings.

FIG. 1 is a partial perspective view showing an open refrigerator door according to the related art. Referring to FIG. 1, a refrigerator 1 is provided with a main body 10 defining a storage compartment within and constituting the exterior of the refrigerator 1, and a door 20 that opens and closes the storage compartment at the front of the main body 10.

The door 20 is installed as a drawer that can be withdrawn and inserted, and for this end, a rail assembly 30 connects the door 20 to the inner walls of the main body 10. The rail assembly 30, configured to be extendable in stages, is fixed to the main body 10 at one end on a rail guide 32, and the other end thereof is fixed to the lower surface of the door 20 or to a door frame 22 that supports the door 20.

The rail assembly 30 is configured as conventionally-used rails having ball bearing interposed at the top and bottom between guides to allow sliding withdrawal/insertion, and is positioned between the inner walls of the main body 10 and a basket 40.

The basket 40 is seated between the rail assemblies 30 at both sides on the left and right thereof. The basket 40 is deeply recessed downward to accommodate larger food items such as vegetables and fruit, and its inner space can be adjusted by a barrier 42 that partitions its interior.

Accordingly, when the door 20 is withdrawn, the rail assembly 30 extends to enable the basket 40 and door 20 to be withdrawn together. The open top of the basket 40 is exposed by withdrawing the basket 40, allowing a user to store foods.

However, the above-configured refrigerator according to the related art has the following drawbacks.

In the related art, when the door 20 is pulled to withdraw the basket 40, a portion of the rail assembly 30 is exposed to the side, presenting an ungainly external appearance.

Moreover, because lubricant such as grease must be applied for the rail assembly 30 to function properly, the lubricant becomes discolored after extended use, adding to the unsightliness. Also, when food is being stored with the basket withdrawn 40, a portion of the lubricant can soil a user, etc., instilling negative sentiments in the user.

Also, in such bottom freezer refrigerators, the door 20 and basket 40 present a comparatively wide breadth, which can result in twisting of the basket 40 during withdrawal/insertion when weight is concentrated at one side.

Accordingly, the seal of the storage compartment formed by the door 20 can be compromised, resulting in leakage of cold air and one of the left and right-side rail assemblies 30 being either damaged or deformed from an uneven weight bias concentrated thereon, thus inhibiting smooth withdrawal/insertion of the basket 40.

To obviate the above problem, an anti-wobble member configured with a rack and pinion can further be provided, to enable smooth withdrawal/insertion of the basket 40 and door 20 without their wobbling.

In this case, however, not only is installing the anti-wobble member difficult, but assembling the basket 40 and rail assembly 30, the anti-wobble member, and other components is also complicated.

SUMMARY

Embodiments provide a refrigerator and an assembling method thereof.

In one embodiment, a refrigerator includes: a main body provided with a storage space; a storage member movably installed in the main body; an extendable rail member between the storage member and the main body, to guide withdrawal and insertion of the storage member; and a cover member at one side of the rail member to cover the rail member.

In another embodiment, a refrigerator includes: a main body provided with a storage space; a storage member received in the storage space and capable of being withdrawn and inserted; a rail member mounted at a distance from an inner surface of the main body, and connecting the storage member and the main body to enable the storage member to be withdrawn from and inserted in the main body; and a storage member bent portion integrally formed with the storage member, to cover the rail member.

In a further embodiment, a refrigerator includes: a main body opened and closed by a drawer-type door; a storage member that moves forward from and rearward toward the main body in connection with the door; a rail member extendably coupled to an inner surface of the main body, to guide movement of the storage member; a fixing member supporting the rail member on the inner surface of the main body; a mounting bracket inserted in the fixing member, to separate the rail member from the main body; a cover member covering at least a portion of the rail member, to prevent external exposure of the covered portion of the rail member; a rack longitudinally coupled to the fixing member; a pair of pinions at an end of the rail member, for moving along the rack; and a shaft connecting the pinions.

In a still further embodiment, a method for assembly a refrigerator, includes: mounting a fixing member inside a main body of the refrigerator, the fixing member forming a fixing slot with at least one side open; forming a door assembly through coupling a door that opens and closes a storage space to a rail member enabling the door to be withdrawn and inserted; and mounting the door assembly inside the storage space through inserting a mounting member at a side of the rail member into the fixing slot.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings. The spirit and scope of the present disclosure, however, shall not be construed as being limited to embodiments provided herein. Rather, it will be apparent that other embodiments that fall within the spirit and scope of the present disclosure may easily be derived through adding, modifying, and deleting elements herein.

Below, embodiments of refrigerators and assembling methods of refrigerators according to the present disclosure will be described in detail with reference to the drawings.

Figure 1:
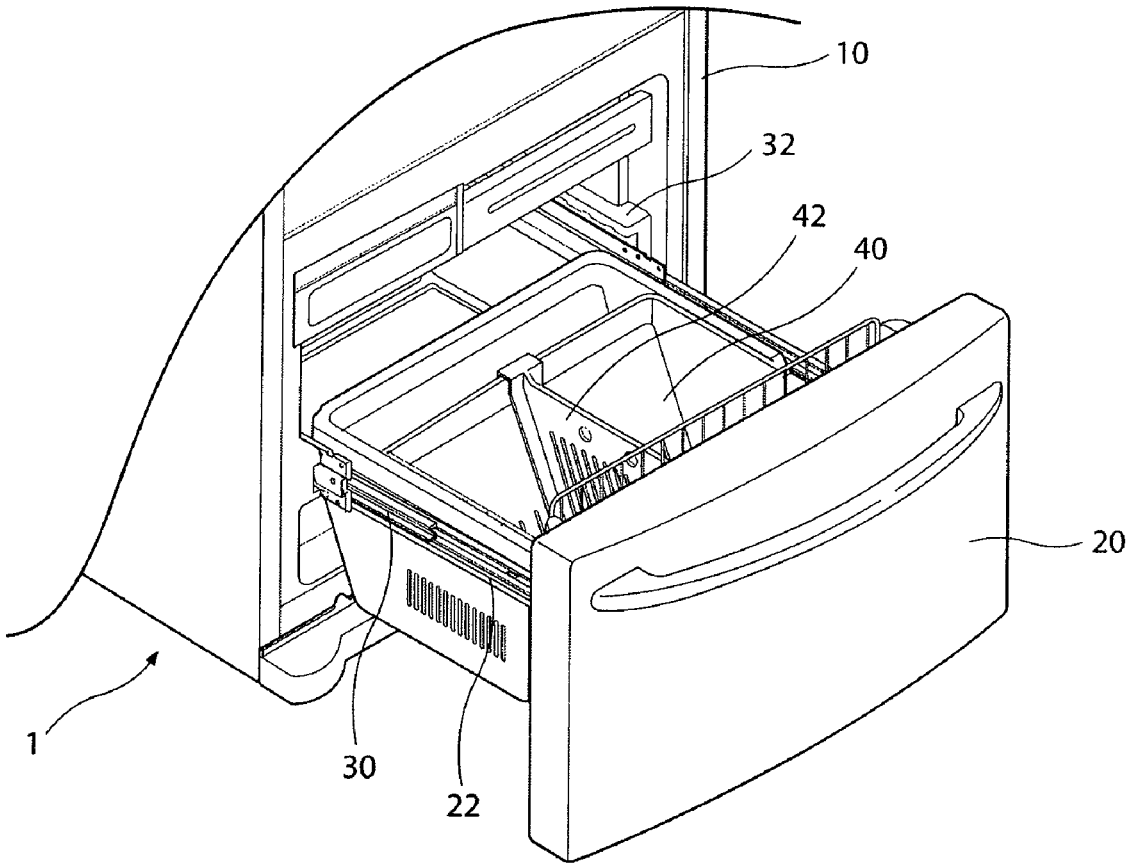
FIG. 1 is a partial perspective view showing an open refrigerator door according to the related art.
Figure 2:
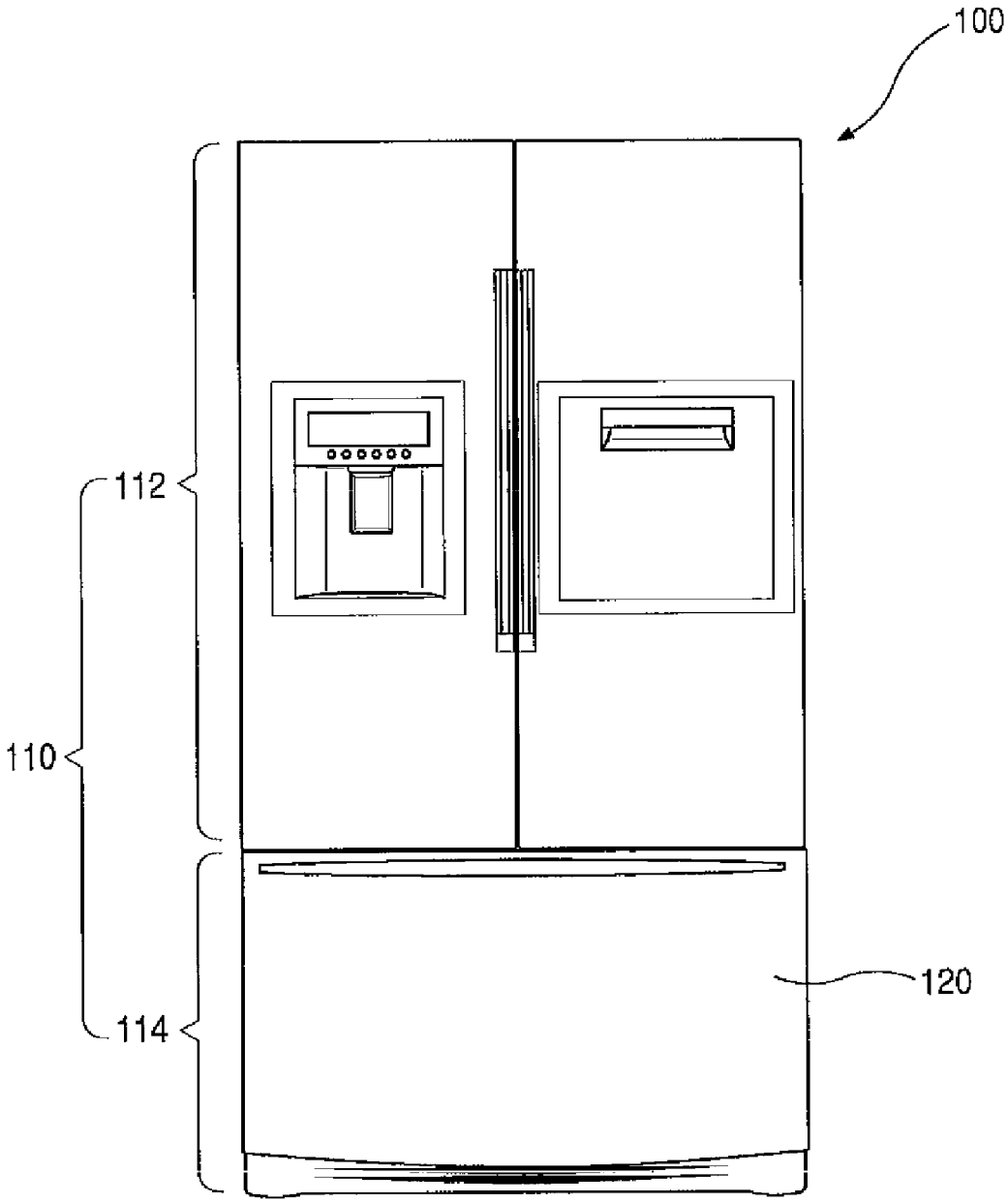
FIG. 2 is a frontal view showing the exterior of a refrigerator according to the present disclosure.

FIG. 2 is a frontal view showing the exterior of a refrigerator according to the present disclosure. Referring to FIG. 2, a refrigerator 100 is configured overall by a main body 110 formed in a hexahedral shape and defining a storage space within, and a door 120 selectively opening and closing the storage space of the main body 110.

The storage space within the main body 110 is vertically partitioned into a refrigeration compartment 112 above and a freezer compartment 114 below. The open front of the refrigeration compartment 112 is selectively opened and closed at the left and right by a pair of pivoting doors, and the open top of the freezer compartment 114 is selectively opened and closed by a withdrawn/inserted drawertype door 120.

Figure 3:
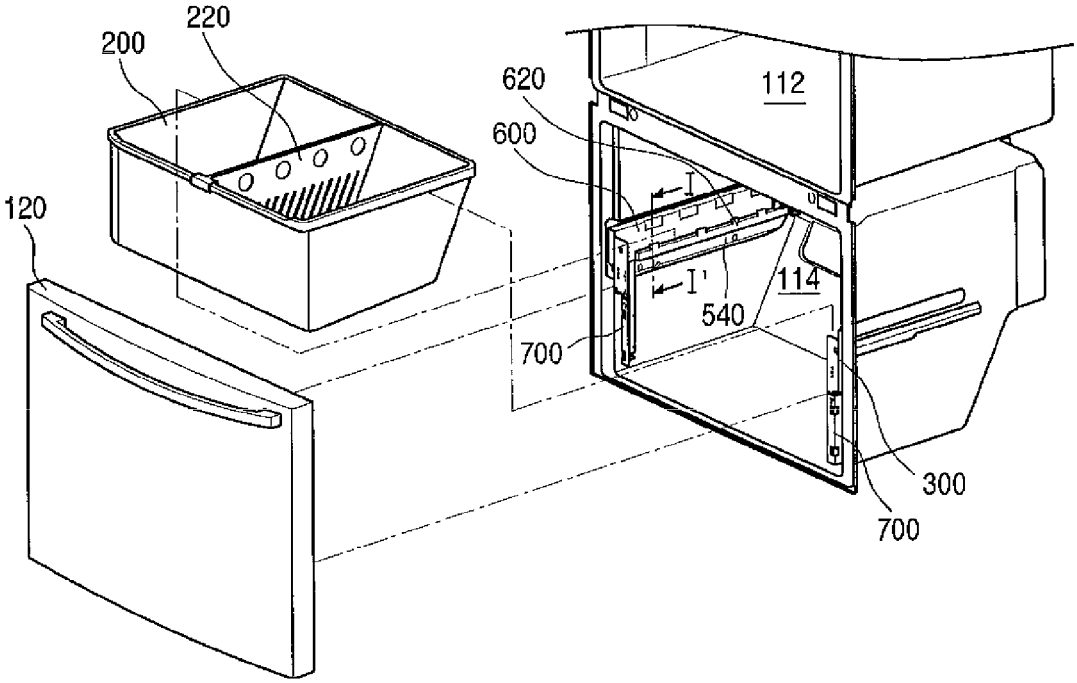
FIG. 3 is an exploded perspective view showing the structure of a drawer-type storage space of a refrigerator according to the present disclosure.

A more detailed description of the door opening and closing the freezer compartment and the internal structure of the freezer compartment will be provided, with reference to FIG. 3.

FIG. 3 is an exploded perspective view showing the structure of a drawer-type storage space of a refrigerator according to the present disclosure. Referring to FIG. 3, a slidingly withdrawn/inserted storage member 200 linked to the withdrawal and insertion of the door 120 is provided within the freezer compartment 114.

The storage member 200, as a vessel capable of storing foods, is generally formed of a plastic material or a wire material and configured to be selectively separable from the inside of the freezer compartment 114.

The storage member 200 is formed with a width corresponding to the inner width of the freezer compartment 114, so that food can be stored through the open top thereof. The interior of the storage member 200 can be partitioned laterally by means of a barrier 220, and the ratio of the partitioned spaces can be varied by moving the barrier 220.

Rail members 400 at left and right opposing positions of the storage member 200*a* are disposed within the main body 110, and a door frame 700, etc. coupled to the door 120 is provided, so that the storage member 200 can be withdrawn/inserted by manipulating the door 120.

Figure 4:
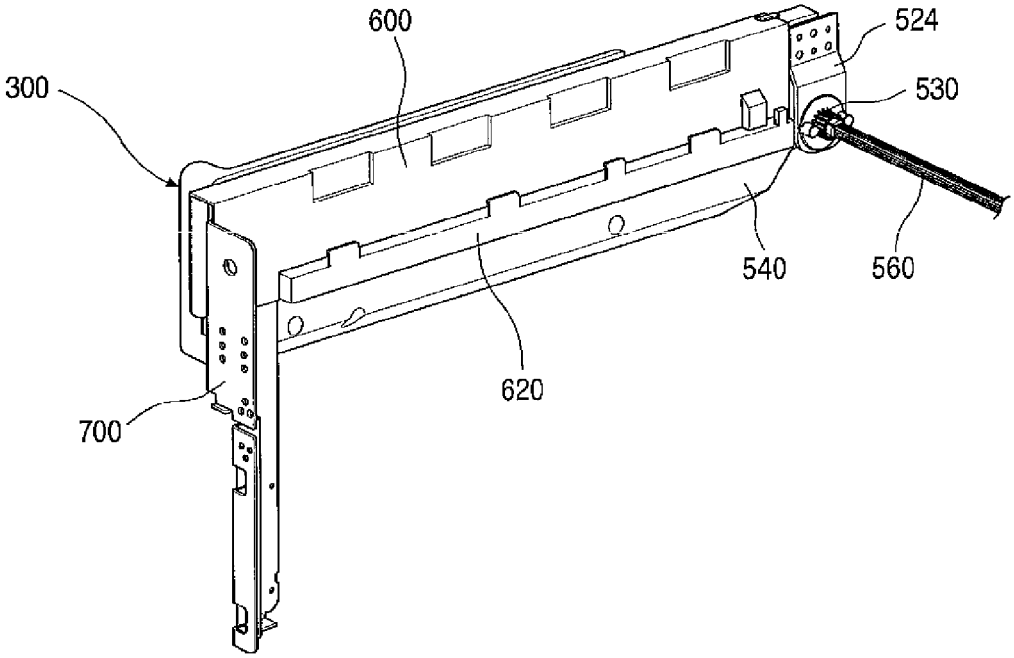
FIG. 4 is a perspective view showing the exteriors of coupled structural elements of a refrigerator according to the present disclosure.
Figure 5:
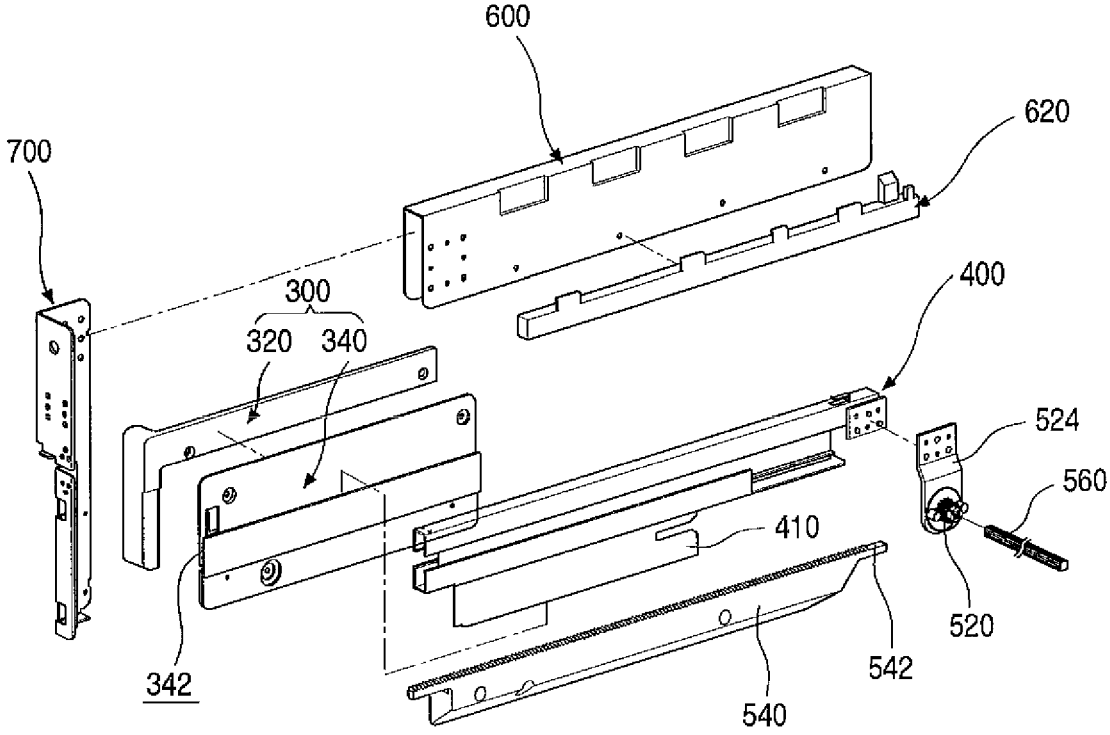
FIG. 5 is an exploded perspective view showing how structural elements of a refrigerator are coupled according to the present disclosure.
Figure 6:
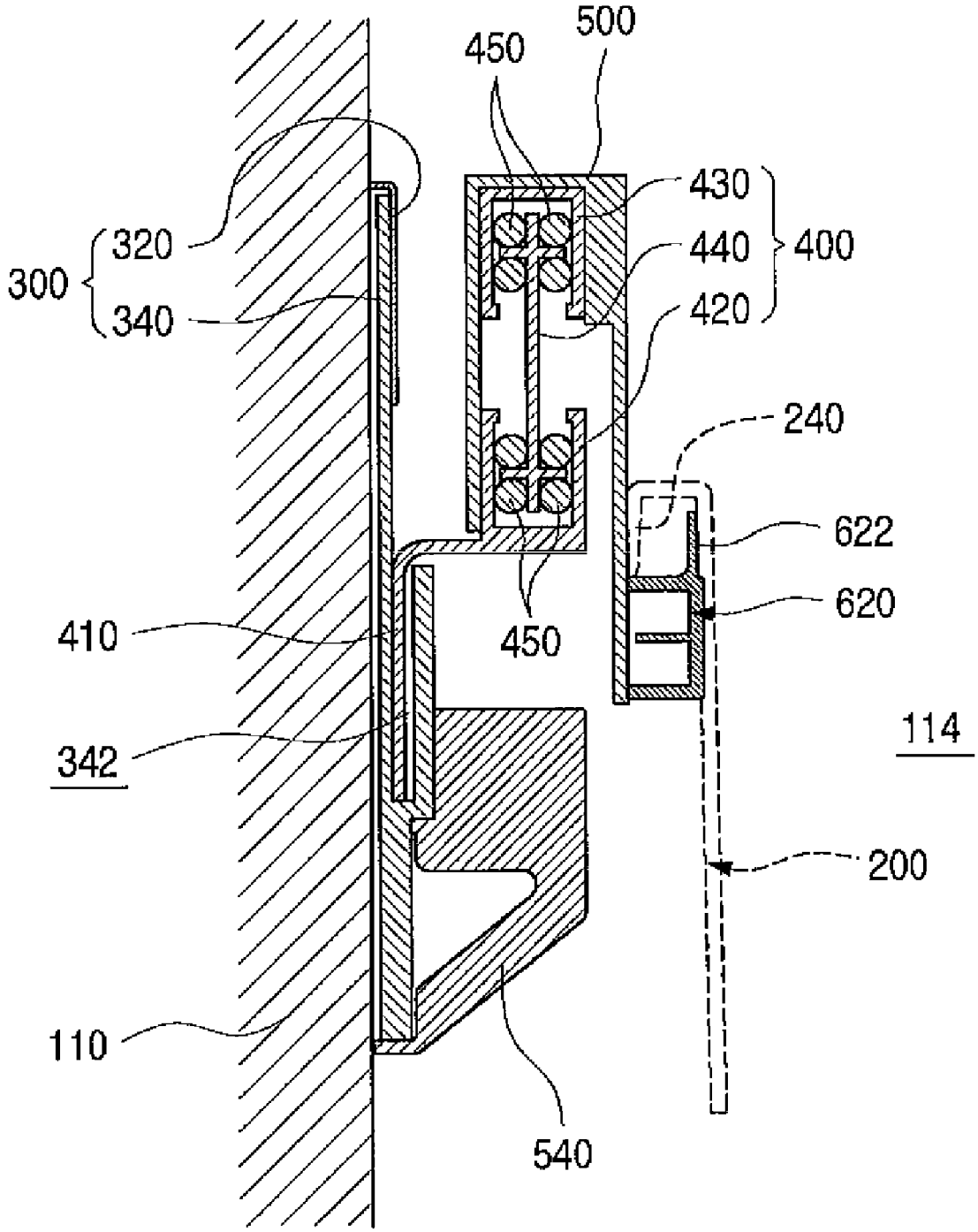
FIG. 6 is a sectional view of FIG. 3 taken along line I-I'.

FIG. 4 is a perspective view showing the exteriors of coupled structural elements of a refrigerator according to the present disclosure, FIG. 5 is an exploded perspective view showing how structural elements of a refrigerator are coupled according to the present disclosure, and FIG. 6 is a sectional view of FIG. 3 taken along line I-I'.

Referring to FIGS. 4 to 6, a rail member 400 that slides forward/rearward to selectively extend in length, a fixing member 300 fixed to the rail member 400 to fix the rail member 400 to the inside of the main body 110, a cover member 600 enclosing the rail member 400, and an anti-wobble member 500 coupled to the rail member 400 to prevent lateral movement and twisting of the drawer are coupled together in an assembly, and this assembly is provided inside the of the main body 110.

In further detail, the fixing member 300 is mounted respectively on both left and right inner walls of the refrigerator 100. The fixing members 300 function as supports for fixedly mounting the rail member 400, and are formed of a fixing member cover 320 and a fixing member plate 340. The fixing member cover 320 is approximately 'L' shaped to cover the front end and upper end of the fixing member plate 340, and has a front end that hooks and mounts to the open front end of the freezer compartment 114.

The fixing member plate 340 has an approximately rectangular plate shape, and a fixing slot 342 is defined in the fixing member plate 340. In order to insert a mounting bracket 410 of the rail member 400 (to be described in detail below), the fixing slot 342 is open at the front and the top, and is formed elongated from the front to rear of the fixing member plate 340.

The rail member 400 is formed elongated in a lengthwise direction, and is configured to be withdrawn in stages and extended. The length of the rail member 400 is greater than the length of the fixing member plate 340, and is fixedly installed through the mounting bracket 410 formed at the bottom of the rail member 400 to the fixing member plate 340.

Here, the mounting bracket 410 is bent to enable the rail member 400 to be mounted with a small lateral gap with respect to the fixing member plate 340, in order to support the rail member 400 from below.

A pinion 520 (that is a component of the anti-wobble member 500) is mounted at the rear of the rail member 400. The pinion 520 is fixed to the rear of the rail member 400 through a pinion bracket 524 coupled with the rail member 400, and a gear formed on the outer periphery of the pinion 520 is engaged to a gear formed on a rack 540 (to be described below).

A shaft 560 is installed between the pinion 520 respectively provided at the left and right sides within the freezer compartment 114. The shaft 560 is mounted through the rotational axes of the pinions 520, and the pinions 520 at both left and right sides thereof are made to rotate in concert in order to prevent twisting or wobbling of the storage member 200 during withdrawal/insertion.

The rack 540 interacting with the pinion 520 is formed elongated, and has gears formed on its upper surface facing the pinion 520 and engaging with the gears formed on the pinion 520, enabling the pinion 520 to move along the rack 540.

That is, the rack 540 is mounted on the fixing member plate 340 below the rail member 400, in a position contacting the outer periphery of the pinion 520. Thus, when the rail member 400 is selectively extended through sliding, the pinion 520 moves along the rack 540.

The rack 540 is formed to correspond in length with the rail member 400, to guide the pinion 520 when the rail member 400 is withdrawn/inserted. Here, an aligning portion 540 is further formed at the rear portion of the rack 540, instead of the gear.

The aligning portion 542 functions to align the position of the pinion 520 when the rail member 400 is completely inserted, and is formed flat without gears. Therefore, when the pinion 520 is disposed at the aligning portion 542, the pinion 520 does not rotate further along the rack and is retained in a fixed position.

As described above, the aligning portion 542 may be formed on at one end of the rack 540; however, according to need, a separate space may be defined at the rear of the rack 540 so that when the storage member 200 is completely inserted, the pinion 520 may be disposed to the rear of the rack 540.

A cover member 600 is seated on the upper portion of the rail member 400. The cover member 600 covers the outside of the rail member 400 to prevent the rail member 400 from being exposed at the side, and is seated from above the rail member 400 to cover both side surfaces of the rail member 400.

That is, the cover member 600 has a sectional 'C', shape when viewed from the front, and the open portion thereof is inserted and mounted over the rail member 400 from above. The cover member 600 contacts the upper surface and the left and right side surfaces of the rail member 400.

In particular, because the outer portion of the cover member 600 that covers the surfaces of the rail member 400 exposed to the outside is formed in a length corresponding to the length of the rail member 400 from top to bottom, the rail member 400 can be completely concealed.

Also, the cover member 600 may be formed to the inside of the rail member 400 or may be formed from the top to bottom of the rail member 400. The length of the cover member 600 required for covering the inner portion of the rail member 400 may be minimal or may be nil.

The cover member 600 is formed elongated to cover the entirety of the rail member 400 with the exception of the rear of the rail member 400, in order to allow the pinion bracket 524 to be mounted at the rear of the rail member 400.

The cover member 600 is fixed to the rail member 400 by inserting its rear in a cover holder 432 on the upper surface of the rail member 400, and coupling its front to the upper surface of the rail member 400 by means of a coupling member such as a screw.

The inner surface of the cover member 600—that is, the surface adjacent to the storage member 200—is further provided with a seating member 620. The seating member 620 allows the storage member 200 to be mounted, and is formed to extend from front to rear on the inner surface of the cover member 600.

The seating member 620 is formed with a predetermined width protruding from the inner surface of the cover member 600, and a plurality of seating ribs 622 is provided to protrude upward from the outer end at the upper surface of the seating member 620. Thus, a storage member bent portion 240 bent at either of the left and right ends of the storage member 200 can be seated from above the seating member 620.

A door frame 700 is mounted at the front portion of the cover member 600. The door frame 700 is for supporting the door 120, and is coupled to either side at the left and right rear surface of the door 120 and formed of a predetermined length extending from the top to bottom portions of the door 120.

The door frame 700 is formed to have a cross section bent in an 'L' shape to be coupled to the rear surface of the door 120, and the upper end at the other surface thereof is coupled to the cover member 600.

The door frame 700 and the cover member 600 are coupled and integrated, the door frame 700 is coupled to the door 120, and the cover member 600 is coupled to the rail member 400. Therefore, the rail member 400 is made to be withdrawn/inserted when the door 120 is withdrawn/inserted.

Figure 7:
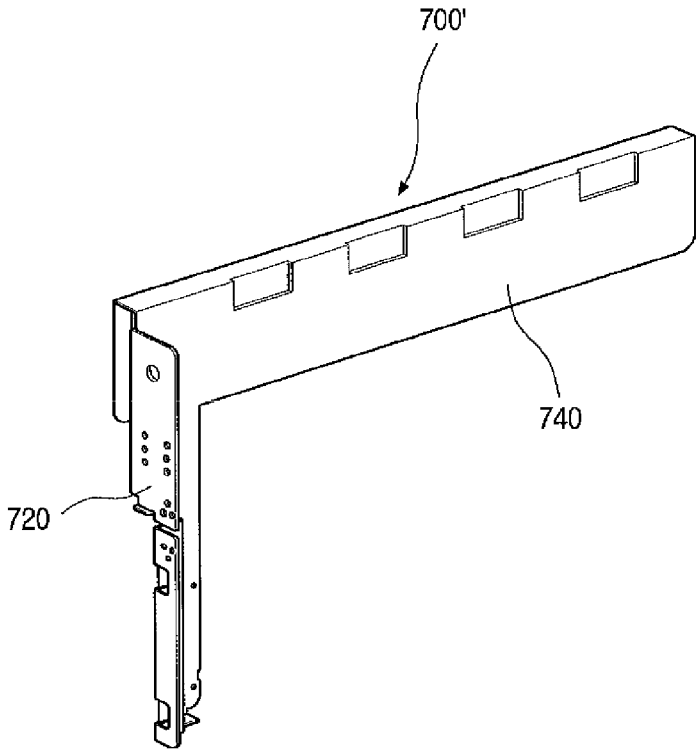
FIG. 7 is a perspective view showing the exterior of a cover member of a refrigerator according to the present disclosure.

According to requirements, the door frame 700 and the cover member 600 may be formed as separate members, or only one door frame may be formed (as shown in FIG. 7).

FIG. 7 is a perspective view showing the exterior of a cover member of a refrigerator according to the present disclosure. Referring to FIG. 7, to enable a door frame 700' to be joined and coupled at its surface with the rear surface of the door 120, the door frame 700' includes a bent door coupling portion 720, and a seating portion 740 formed to extend rearward from the door coupling portion 720 to be seated on the rail member 400.

The seating portion 740 is formed elongated to have a 'C' shaped cross section to be capable of covering both side surfaces of the rail member 400 when seated on the rail member 400, in order to cover the outside of the rail member 400 exposed to the outside.

The door coupling portion 720 of the door frame 700' may further be provided with a hinge assembly (not shown) at the bottom thereof to enable the door 120 to be tilted open. Here, the lower portion of the door frame 700' to which the hinge assembly is mounted is pivotably coupled at a lower portion of the rear surface of the door 120.

Figure 8:
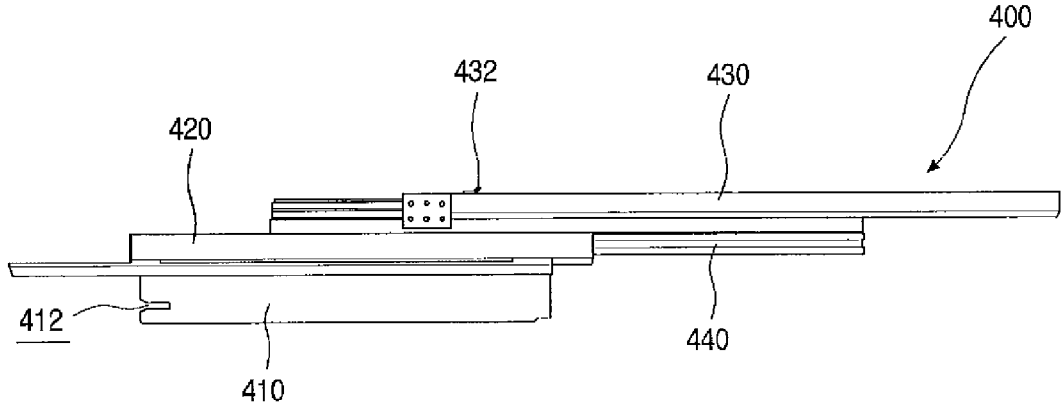
FIG. 8 is a plan view showing the exterior of a rail member of a refrigerator according to the present disclosure.

FIG. 8 is a plan view showing the exterior of a rail member of a refrigerator according to the present disclosure.

As shown in FIGS. 7 and 8, the rail member 400 is configured with a lower guide 420, an upper guide 430, and a slider 440.

The lower guide 420 allows the rail member 400 to be fixed and mounted to the fixing member 300 and also guides the movement of the slider 440, and is formed to be open at the top to receive the lower portion of the slider 440. Also, a bearing 450 is built in between the inside of the lower guide 420 and the lower portion of the slider 440.

The bearing 450 is respectively provided in the upper portion and the lower portion at which the lower guide 420 and the slider 440 are close together, to support the slider 440 from both left and right sides and distribute the load imparted to the rail member 400.

The mounting bracket 410 is provided on the undersurface of the lower guide 420. After the mounting bracket 410 is extended a predetermined distance laterally from the bottom of the lower guide 420, it is bent perpendicularly downward.

Here, the bent portion is formed in a length corresponding to that of the fixing slot 342 of the fixing member plate 340. Accordingly, when the bent portion is inserted in the fixing slot 342, one side of the mounting bracket 410 extending laterally is pressed from above by an upward limiter 344, described below.

Also, the rear of the bent portion of the mounting bracket 410 has a cut portion 412 cut and recessed forward. The cut portion 412 has the rearward limiter 346 (to be described) inserted therein to prevent the mounting bracket 410 from moving.

That is, the mounting bracket 410 is inserted in the fixing slot 342 of the fixing member plate 340 and fixed to the fixing member 300, to thereby securely fix and mount the rail member.

The mounting bracket 410 inserted in the fixing slot 342 extends laterally from the lower guide 420, so that the mounting of the mounting bracket 410 maintains the lower guide 420 in a separated state from the fixing member plate 340.

That is, through insertion of the mounting bracket 410, the rail member 400 is mounted to not impart transferring force and to provide downward support, so that not only is a more secure mounting structure provided, but the rail member 400 is also capable of sliding smoothly.

Because the cover member 600 can be disposed between the rail member 400 and the inner wall of the refrigerator, the exterior of the rail member 400 can be sealed and not exposed to the outside. Of course, instead of the cover member 600, the seating portion 740 of the door frame 700 may be interposed and inserted between the bent outer ends of the storage member 200 to cover the exposed side of the rail member 400.

The mounting bracket 410 may be integrally formed with the lower guide 420 of the rail member 400, and depending on need, the mounting bracket 410 that is formed as a separate member may be coupled to the undersurface of the lower guide 420 through a method such as welding.

A slider 440 is further provided above the lower guide 420 to roll forward and rearward along the lower guide 420, and a plurality of bearings 450 is provided at the upper portion and lower portion of the slider 440 to enable the slider 440 to smoothly slide between the lower guide 420 and an upper guide 430.

The upper guide 430 is provided above the slider 440 to slide forward and rearward along the slider 440. The upper guide 430 is formed open at the bottom to receive the upper portion of the slider 440, and when the slider 440 is mounted, the top of the lower guide 420 and the bottom of the upper guide 430 are slightly separated.

With the slider 440 received in the upper guide 430, the upper guide 430 is supported on the slider 440 through the bearing 450. The bearing 450 is provided in pairs, with one pair at the upper portion and another pair at the lower portion of the slider 440, such that the load on the upper guide 430 is distributed and securely supported. A plurality of bearings 450 is thus built in, separated at predetermined intervals lengthwise along the slider 440.

A cover holder 432 is further formed at the rear upper surface of the upper guide 430, in which the rear of the cover member 600 is inserted and fixed. The cover holder 432 is bent to enable the rear of the cover member 600 to be press-fitted therein, and a portion of the upper surface of the upper guide 430 is cut and then bent.

The configuration of the fixing member 300 will be described in further detail with reference to FIGS. 9 to 13.

Figure 9:
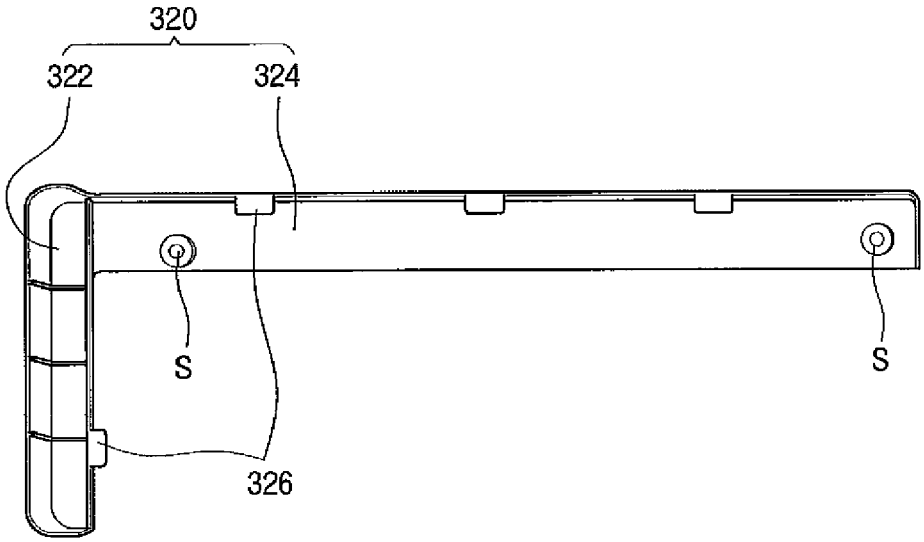
FIG. 9 is a perspective view showing the rear structure of a fixing member cover of a refrigerator according to the present disclosure.

FIG. 9 is a perspective view showing the rear structure of a fixing member cover of a refrigerator according to the present disclosure. As shown, the fixing member cover 320 that is an element of the fixing member 300 is formed approximately in an 'L' shape, and a cover front portion 322 extending downward is bent so that it can be hooked and mounted on the front surface and inner edge surface of the main body 110.

Also, the cover upper portion 324 extending laterally is formed to extend the distance of the fixing member plate 340, and has a predetermined width enabling it to overlap with the upper portion of the fixing member plate 340.

The cover upper portion 324 defines a screw hold (S) in which a screw passing through the fixing member plate 340 can be fastened, and a plurality of retainers 326 is formed on the upper end of the cover upper portion 324 and a side of the cover front portion 322 to press against and retain the fixing member plate 340.

Figure 10:
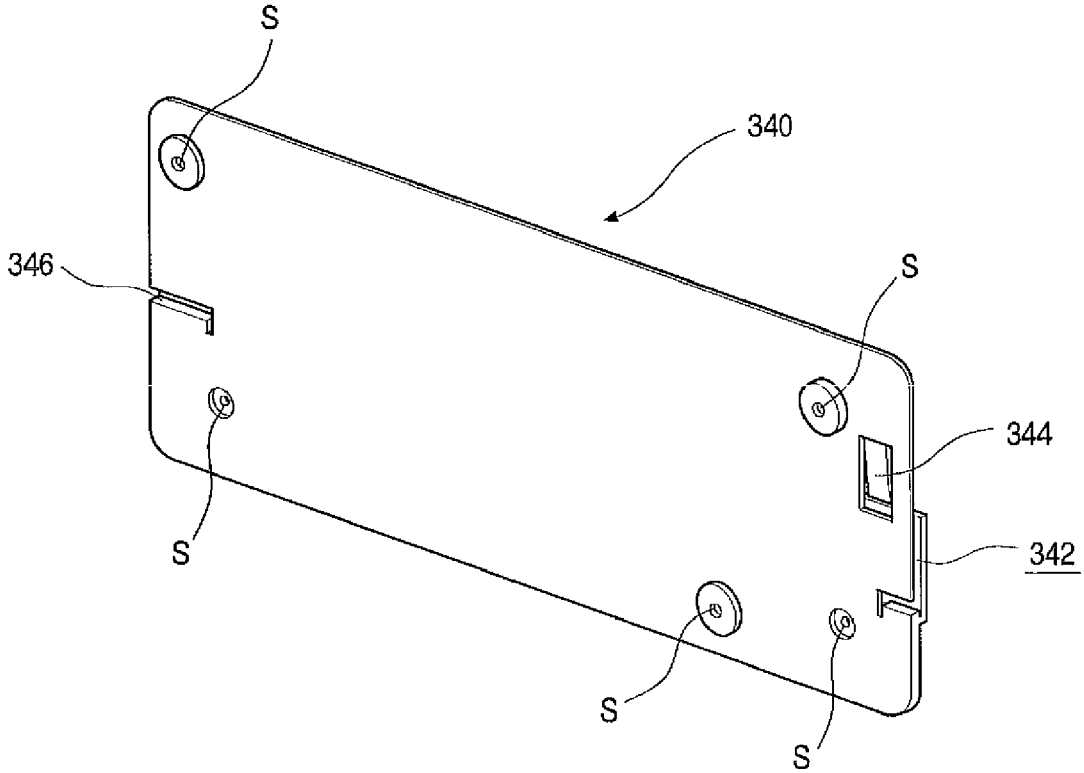
FIG. 10 is a perspective view showing the rear surface of a fixing member plate of a refrigerator according to the present disclosure.
Figure 11:
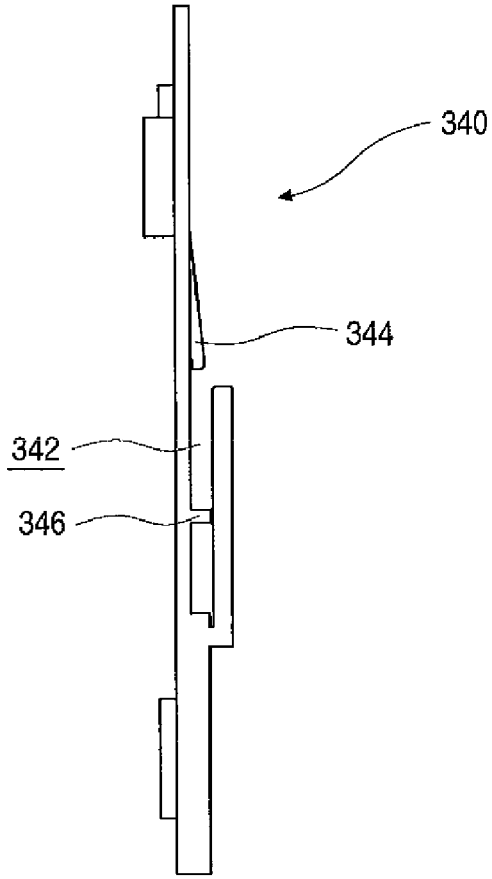
FIG. 11 is a frontal plan view of a fixing member of a refrigerator according to the present disclosure.
Figure 12:
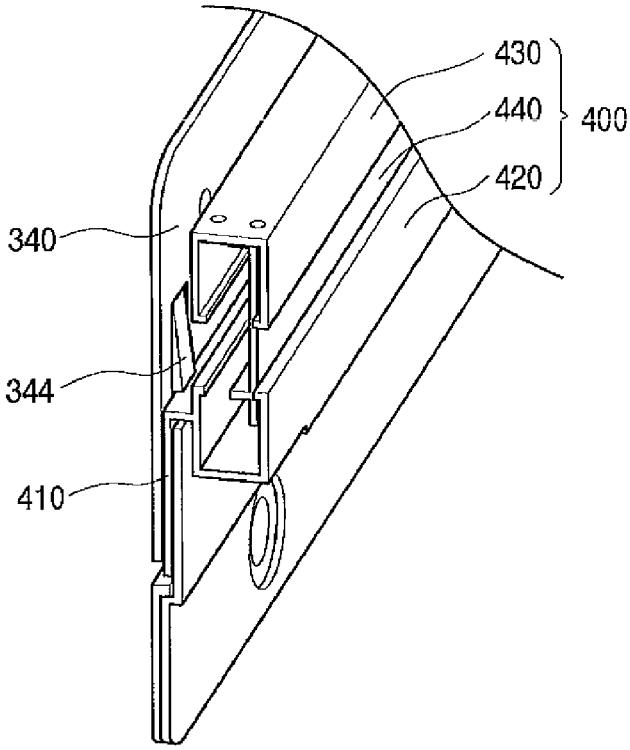
FIG. 12 is a perspective view showing the coupling of a rail member and a fixing member of a refrigerator according to the present disclosure.

FIG. 10 is a perspective view showing the rear surface of a fixing member plate of a refrigerator according to the present disclosure, FIG. 11 is a frontal plan view of a fixing member of a refrigerator according to the present disclosure, and FIG. 12 is a perspective view showing the coupling of a rail member and a fixing member of a refrigerator according to the present disclosure.

Referring to FIGS. 10 to 12, as a rectangular plate, the fixing member plate 340 forms a fixing slot 342 from a front portion to a rear portion in a surface of the fixing member plate 340.

The fixing slot 342 allows the mounting bracket to be mounted, and is formed by first extending a surface of the fixing member plate 340 outward and then bending and extending it perpendicularly upward.

An upward limiter 344 is formed at the top of the front portion of the fixing member plate 340. The upward limiter 344 presses and fixes the bent portion of the mounting bracket 410 from above, and is formed by cutting a side of the fixing member plate 340 that is then bent at a predetermined angle to progressively project outward in a downward direction. Here, the bottom of the upward limiter 344 is disposed above the open fixing slot 342.

The upward limiter 344 is formed to have an inward elastic bias. Accordingly, inserting the mounting bracket 410 from above the fixing slot 342 is easy, and as shown in FIG. 12, after the mounting bracket 410 has been inserted, upward movement of the mounting bracket 410 can be prevented by pressing the bent upper surface of the mounting bracket 410.

The rear of the fixing member plate 340 has a rearward limiter 346 formed thereon. The rearward limiter 346 is inserted in the bent portion 412 formed at the rear of the mounting bracket 410 to retain the mounting bracket 410, and is formed on a side of the fixing member plate 340 corresponding to the cut portion 412.

That is, the rearward limiter 346 is formed inside the fixing slot 342, by cutting a side of the fixing member plate 340. Also, the rearward limiter 346 has the cut portion bent perpendicularly outward to insert into the cut portion 412 when the mounting bracket 410 is mounted to the fixing slot 342.

Accordingly, the rearward limiter 346 is able to retain the mounting bracket 410 from the rear, to prevent vertical movement of the mounting bracket 410 and retain the mounting bracket 410 so that it is not pushed rearward.

Also, a plurality of screw holes (S) is formed in the fixing member plate 340 in which screws are fastened. Of these, the upper screw holes (S) are for coupling the fixing member cover 320, and the lower screw holes (S) are for coupling the rack 540.

Figure 13:
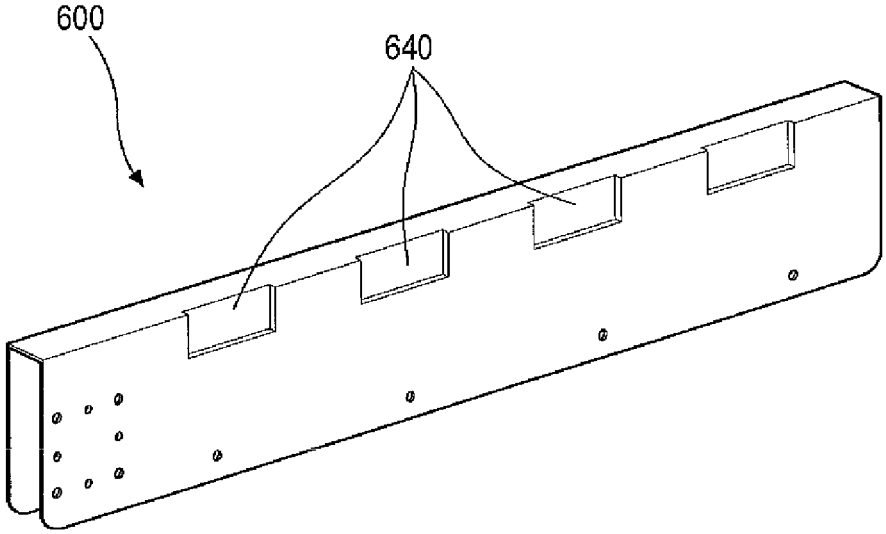
FIG. 13 is a perspective view showing the shape of a cover member of a refrigerator according to the present disclosure.

FIG. 13 is a perspective view showing the shape of a cover member of a refrigerator according to the present disclosure. Referring to FIG. 13, the cover member 600 is a structure mounted from above the rail member 400 to cover the exterior of the rail member 400, and covers the entirety or a portion of both sides of the rail member 400 according to how much it extends downward at either side.

The cover member 600 is inserted from above the rail member 400 and is pressed closely against the upper guide 430, and the front and rear of the cover member 600 are respectively retained in a fixed state on the upper guide 430.

In accordance, when the upper guide 430 is slid, the cover member 600 moves in concert, and the movement of the cover member 600 can be linked to sliding movements of the storage member 200 seated on the seating member 620 of the cover member 600 or the upper guide 430.

Further, a recessed portion 640 is further formed in the cover member 600 to minimize interference with the side surface portion of the rail member 400 during sliding movement. The recessed portion 640 is recessed inward at the upper portion of the inner surface of the cover member 600, to define spaces between either side surface of the cover member 600 and the rail members 400 and minimize interference with a side of the rail member 400 when the cover member 600 is moved.

The front top portion of the cover member 600 defines a screw hole (S) for coupling the cover member 600 to the upper guide 430, and the front portion of the inner surface of the cover member 600 defines screw holes (S) for coupling with the door frame 700. The lower portion of the inner surface of the cover member 600 defines screw holes (S) for coupling the seating member 620.

Figure 14:
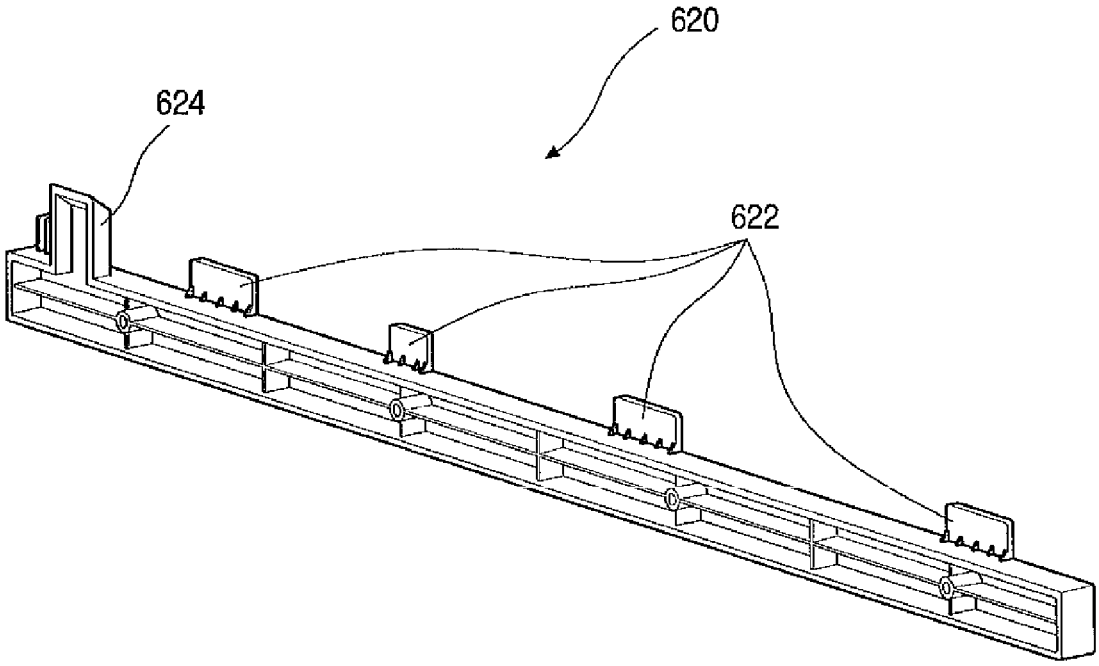
FIG. 14 is a perspective view showing the rear shape of a seating member of a refrigerator according to the present disclosure.

FIG. 14 is a perspective view showing the rear shape of a seating member of a refrigerator according to the present disclosure. Referring to FIG. 14, the seating member 620 is formed in the same length as the cover member 600, and is mounted to project from inside the cover member 600 in order to seat the storage member 200.

Also, a plurality of seating ribs 622 is formed extending perpendicularly upward from along the outer end of the seating member 620. Accordingly, when the storage member 200 is seated, the storage member 200 can be maintained in a securely seated state without wobbling.

A storage member retainer 624 is further formed on the rear of the seating member 620 to project upward. The storage member retainer 624 supports the rear of the storage member 200 from the rear when the storage member 200 is seated, to prevent the storage member 200 from being pushed rearward during withdrawal/insertion of the storage member 200.

The rail member 400 and the fixing member 300 are provided with an anti-wobble member 500 for ensuring secure withdrawal/insertion of the storage member 200. The anti-wobble member will be described in detail below, with reference to the diagrams.

Figure 15:
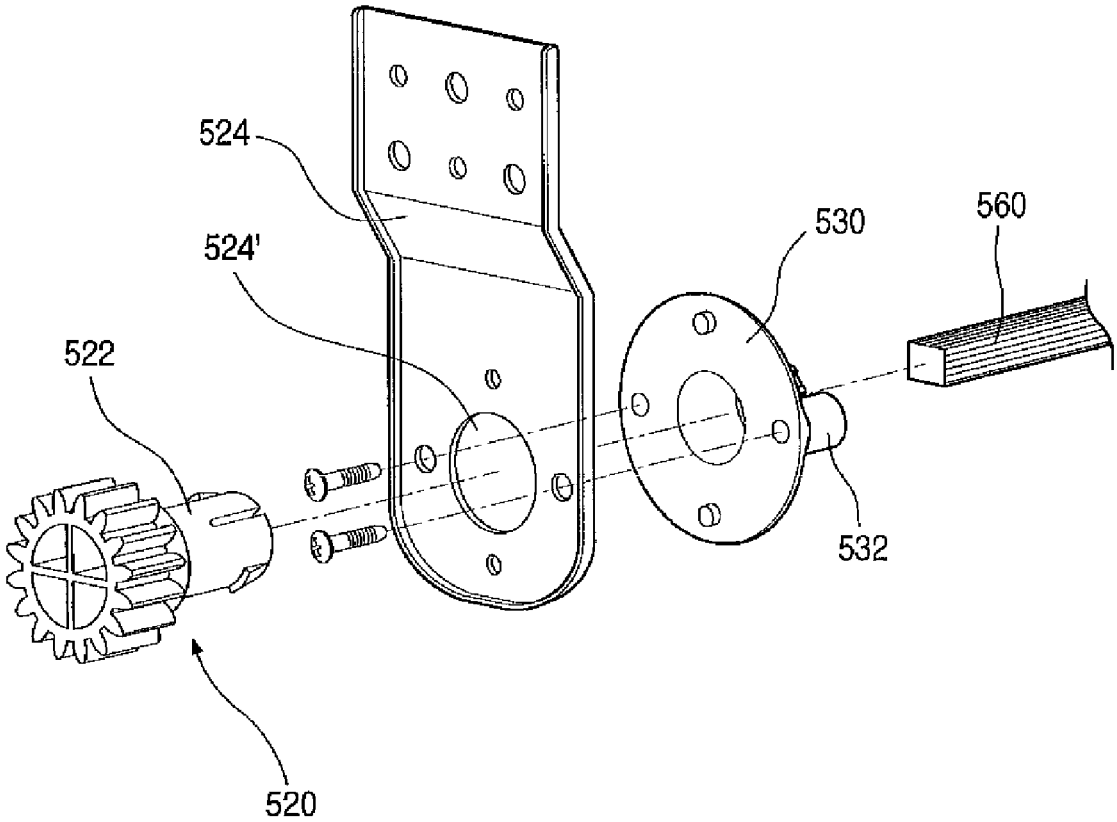
FIG. 15 is an exploded perspective view showing the coupling structure of a pinion of a refrigerator according to the present disclosure.
Figure 16:
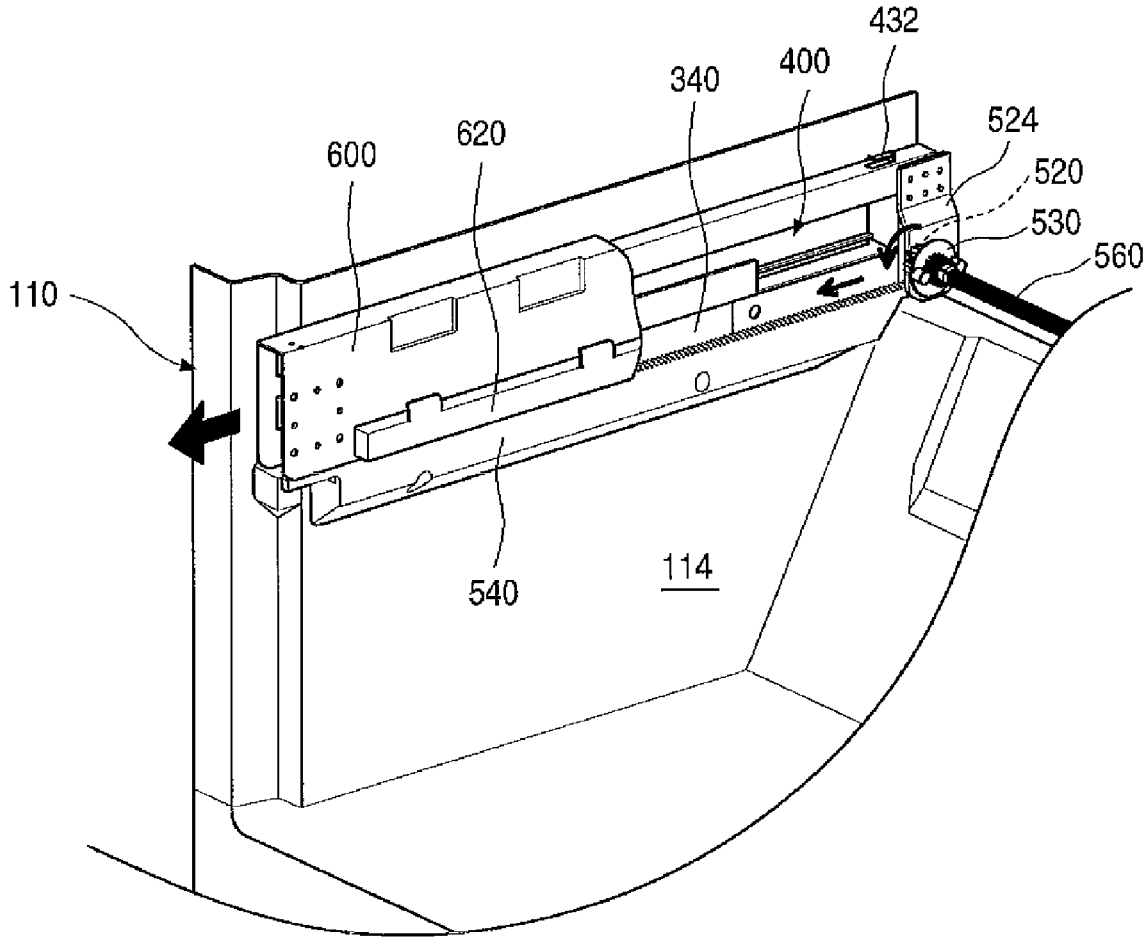
FIG. 16 is a partial perspective view showing the coupling structure of an anti-wobble member of a refrigerator according to the present disclosure.

FIG. 15 is an exploded perspective view showing the coupling structure of a pinion of a refrigerator according to the present disclosure, and FIG. 16 is a partial perspective view showing the coupling structure of an anti-wobble member of a refrigerator according to the present disclosure.

As shown in FIGS. 15 and 16, the anti-wobble member 500 includes a rack 540 coupled to the fixing member 300, a pinion 520 coupled to the rail member 400 for moving along the rack 540, and a shaft 560 provided between and connecting two pinions 520 on either end.

The rack 540 is coupled to the lower portion of the fixing member plate 340, and gears are continuously formed on the upper portion of the rack 540. Here, the gears are configured to correspond to gears of the pinion 520 and are engaged with the gears of the pinion 520, to move with respect to the latter.

The pinion 520 is coupled to the rear portion of the upper guide 430 through a pinion bracket 524. The pinion bracket 524 enables the pinion 520 to be disposed in a position contacting the upper surface of the rack 540, and defines through-holes 524' in the approximate lower central portion thereof, through which the pinion shaft 522 passes.

The pinion 520 is installed such that the pinion shaft 522 passes through the through-holes 524', and is coupled to the pinion guide 530 so that it is cable of rotating on the mounting bracket 410. Here, the pinion guide 530 and the pinion bracket 524 are fixed and coupled by means of coupling holes and projecting coupling protrusions, and bosses 532 for fastening with screws. The pinion 520 rotates about an axis defined by the pinion shaft 522.

Also, the outer end of the pinion shaft 522 is recessed to receive the shaft 560 inserted therein. Here, the recessed portion has a cross sectional shape corresponding to the cross sectional shape of the shaft 560. Accordingly, the shaft 560 and the pinion 520 can rotate together without slipping, and pinions 520 at both left and right ends of the shaft 560 are coupled and can rotate together at corresponding positions on the same horizontal plane.

Below, the operation of a refrigerator with the above configuration will be described with reference to FIGS. 2 to 16.

First, with respect to the assembly procedure of the refrigerator 100, and especially that of the freezer compartment 114, the fixing member 300 is mounted within the freezer compartment 114 at the bottom of the main body 110. Here, the fixing member 300 is already coupled with the fixing member cover 320 and the fixing member plate 340, and is mounted as an assembly with the rack 540 installed on the fixing member plate 340 to the inner case formed on the inner walls of freezer compartment 114.

After the mounting of the fixing member 300 is completed, the pinions 520 are coupled to the pinion bracket 524 at the rear of the upper guide 430. The seating member 620 is coupled to the inner surface of the cover member 600, and the front portion of the cover member 600 is coupled to the door frame 700.

Next, with the seating member 620 and the door frame 700 mounted thereon, the cover member 600 is mounted to the rail member 400. The cover member 600 is inserted downward from above, the rear of the cover member 600 is inserted into the cover holder 432 at the rear on the upper surface of the upper guide 430, and the front of the cover member 600 is coupled and fastened with screws to the upper surface at the front of the upper guide 430.

With the cover member 600 formed as a single unit with the rail member 400, the door frame 700 is coupled to the door 120. The door frame 700 is coupled to the rear surface of the door 120, and if the door 120 is a tilting door, hinge coupling is used to form a tilting structure.

After the mounting of the door frame 700 to either side on the rear surface of the door 120 is completed, the shaft 560 is mounted. The shaft 560 is inserted in and coupled to the pinion shafts 522 on both left and right sides to enable the pinions 520 to rotate in concert.

Next, the storage member 200 is coupled between the cover members 600. Here, the storage member bent portion 240 at either side of the storage member 200 may be seated on top of the seating member 620.

In the above process, after the door frame 700 and rail member 400 coupled to the door 120, the cover member 600, the storage member 200, and the pinions 520 and shaft 560 are assembled as an assembly, the rail member 400 is inserted from the front of the fixing member 300 and mounted.

That is, in order to mount the mounting bracket 410 of the rail member 400 to the fixing slot 342, the rear of the mounting bracket 410 is first inserted diagonally downward from the upper front portion of the fixing slot 342, after which the cut portion 412 of the mounting bracket 410 is inserted to be retained by the rearward limiter 346 of the fixing member plate 340.

Also, when the front portion of the mounting bracket 410 is lowered and inserted in the fixing slot 342, the bent upper surface of the mounting bracket 410 is pressed and restrained by the upward limiter 344 of the fixing member plate 340.

Thus, through inserting the mounting bracket 410 from the front of the fixing slot 342 rearward, the rail member 400 and the assembly coupled to it, including the cover member 600, storage member 200, door frame 700, door 120, etc. are coupled all at once to form a door assembly.

Through insertion of the mounting bracket 410, the pinion 520 coupled to the rail member 400 and the rack 540 coupled to the fixing member 300 are coupled through gears, enabling the anti-wobble member 500 and a coupling enabling natural interaction.

Thus, during assembly, when the door 120 is completely closed, the pinions 520 coupled to the rail members 400 are disposed rearmost. Here, the pinions 520 are disposed at the aligning portions 542. Because the aligning portions 542 are formed flat without any gear teeth, when the pinions 520 are disposed at the aligning portions 542, the pinions 520 are able to rotate freely.

In this state, when the door 120 is pulled to withdraw the storage member 200 once more, the pinions 520 move along the racks 540, and become engaged with the gears of the racks 540 when moved forward.

Accordingly, even when assembled slightly offset when the pinions 520 are not inserted at the same time at the left and right in the initial assembly stage, the door 120 can be closed to position the pinions 520 at the aligning portions 542, after which the door 120 may be pulled to move the pinions 520 forward, whereupon the pinions 520 at the left and right are rotated in automatic alignment, and the door 120 and the storage member 200 retain balance when being withdrawn/inserted.

The processes of withdrawing and inserting a storage member 200 of a refrigerator configured as above according to the present disclosure are as follows.

First, with the door 120 sealing the freezer compartment 114, when the door 120 is pulled, the rail member 400 slides and extends, and the storage member 200 is withdrawn forward. Here, the exterior of the extended rail member 400 is completely covered by the cover member 600, so that the exterior of the rail member 400 is not exposed to the outside.

When the rail member 400 is extended, the slider and upper guide 430 forming the rail member 400 slide and move forward, and the pinion 520 fixed to the upper guide 430 also moves forward due to the movement of the upper guide 430.

Here, when the pinion 520 that is coupled through gears to the rack 540 moves forward while rotating, because the pinions 520 provided on the rail members 400 at the left and right sides, respectively, are connected by the shaft 560, they rotate in concert over the same distance, allowing the rail members 400 to extend.

Accordingly, when withdrawing or inserting the door 120, even if a user imparts force biased to one side, the door 120 and the storage member 200 and the rail member 400 are not biased to one side, do not wobble, and can be securely withdrawn forward.

When the door 120 is pulled to be completely withdrawn, the open top of the storage member 200 is exposed, and storing of food or taking food out can be performed through the storage member 200 open to the outside.

After storage or withdrawal of food in the storage member 200 has been completed, the user pushes the door 120 rearward to insert the door 120 and the storage member 200. Here, the length of the rail 400 shortens, the storage member 200 enters the storage compartment, and the door 120 completely seals the open front of the freezer compartment 114.

When inserting the storage member 200, the slider 440 and the upper guide 430 slide and move rearward according to the contracting length of the rail member 400, and the pinion 520 coupled to the upper guide 430 also moves rearward in concert with the rearward movement of the upper guide 430.

Here, the pinion 520 rotates and moves while engaged through gears with the rack 540, and the pinions 520 provided on the rail members 400 at the left and right sides and connected via the shaft 560 rotate in concert to travel the same distance. Thus, the door 120 and the storage member are not biased or twisted to one side, and can be securely inserted.

Also, when the door 120 is pushed so that the door 120 seals the opened front of the freezer compartment 114, the rail member 400 is completely inserted also, and the pinions 520 are disposed at their rearmost positions.

That is, when the door 120 is closed, the pinions 520 are disposed at the rearmost portions of the racks 540 or at the aligning portions 542 formed at the rear of the racks 540. The aligning portions 542 are formed flat without gears, so that the pinions 520 are not engaged to the aligning portions 542 and can rotate freely.

With the door 120 completely closed and the pinions 520 disposed at the aligning portions 542, when the door 120 is pulled again, the rail member 400 extends again, and accordingly, the pinions 520 move forward from the aligning portion 542 and along the racks 540, so that the pinions 520 and the racks 540 are engaged through gears.

Here, because the pinions 520 are coupled through the shaft 560, they are realigned at the aligning portions 542, and the shaft 560 and the racks 540 are perpendicular at the point where the pinion gears engage with the gears of the racks 540. Thus, the storage member 200 and the door 120 can be withdrawn and inserted without being biased or wobbling.

As described in detail above, a refrigerator according to the present disclosure is projected to have the following effects.

First, a cover member that covers the exterior of the rail member is mounted on the rail member. The cover member is withdrawn or inserted in concert with the withdrawal or insertion of the rail member, so that exposure of sides of the rail member to the outside can be prevented.

Accordingly, complex structures are not outwardly visible when the door is open, thereby upgrading the exterior through presenting a tidy outward appearance and preventing externally exposed grease.

Thus, because the possibility of a user inadvertently soiling clothes or bodily parts with grease can be prevented at the source, dissatisfaction of users can be obviated.

Because the cover member covers the exterior of the rail member, infiltration of impurities to the rail member can be prevented, and water droplets entering and freezing can also be prevented, ensuring reliable operation of the rail member.

Second, the rail member is provided with an anti-wobble member to prevent biasing or wobbling of the door, storage member, etc. when the door is withdrawn or inserted. In particular, an aligning portion is formed at the rear end or the rear of the rack to align the pinions.

Accordingly, even when the pinions are not properly positioned during initial installment, after being completely inserted, the pinions are aligned to evenly withdraw or insert the door and the storage member.

Additionally, even if careless operation leads to temporary biasing or wobbling, because realignment of the pinions is possible, withdrawing and insertion of the door can be rebalanced, thus improving overall user convenience and improving assembly.

Third, a fixing member is mounted on the inner wall of the freezer compartment, and the mounting bracket is inserted in a fixing slot formed on the fixing member, so that the door, door frame, rail member, cover member, anti-wobble member, storage member, etc. can be mounted in a preassembled state at one time.

Accordingly, because a preassembled door can be mounted in a single stage during assembly of a refrigerator, the number of working processes can be greatly reduced, and yield can be increased.

Also, by enabling an anti-wobble function through mounting a preassembled door, working convenience can be immensely improved.

Any reference in this specification to "one embodiment," "an embodiment," "exemplary embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a main body provided with a storage space;

a storage member movably installed in the main body;

an extendable rail member between the storage member and the main body, to guide withdrawal and insertion of the storage member;

a door frame on which the storage member is removably seated, the door frame connecting a door and the rail member;

a cover member disposed on the rail member and having a portion covering the outside of the rail member to prevent the rail member from being exposed at the side, the cover member being separate from and independent of the storage member;

a fixing member supporting the rail member on the inner surface of the main body, and a mounting bracket extending from an undersurface of the rail member and being downwardly inserted into the fixing member to mount the rail member, wherein the rail member is disposed a predetermined space apart from the fixed member, and the cover member portion is disposed in the space between the main body and the rail member.

2. The refrigerator according to claim 1, wherein the cover member is seated on the rail member to cover both left and right sides of the rail member.

3. The refrigerator according to claim 1, wherein the cover member extends from an upper end to a lower end of an exterior of the rail member.

4. The refrigerator according to claim 1, further comprising a seating member at one side of the cover member, to seat the storage member.

5. The refrigerator according to claim 1, wherein the rail member comprises:

a lower guide fixed to the main body;

an upper guide sliding in connection with the storage member;

a slider moving between the upper guide and the lower guide; and a plurality of bearings between the guides and the slider, to support the slider.

6. The refrigerator according to claim 1, wherein the mounting bracket is in a bent shape mounted to the rail member, to space the rail member apart from the inner surface of the main body.

7. The refrigerator according to claim 1, wherein the fixing member comprises:

a fixing slot to insert and fix the mounting bracket; and a limiting member on the fixing member to limit the mounting bracket mounted in the fixing slot.

8. The refrigerator according to claim 7, wherein the fixing slot is open at the front and the top, and is formed elongated from the front to rear of the fixing member.

9. The refrigerator according to claim 7, wherein the limiting member comprises:

a rearward limiter retaining the mounting bracket from a rear; and an upward limiter pressing the mounting bracket from above.

10. The refrigerator according to claim 9, wherein the upward limiter is formed above the open fixing slot by cutting and bending a side of the fixing member, and the rearward limiter is formed inside the fixing slot by cutting and bending a side of the fixing member.

11. The refrigerator according to claim 1, further comprising an anti-wobble member on the rail member and the fixing member to prevent biasing of the storage member.

12. The refrigerator according to claim 11, further comprising a second rail member, wherein the anti-wobble member comprises:

a pinion provided at a side of each of the rail members, respectively, and moving according to withdrawal and insertion of the storage member;

a shaft between and connecting the pinions; and a rack on the fixing member and engaged through gear teeth to the pinions, respectively, to rotate the pinions during withdrawal and insertion of the storage member.

13. The refrigerator according to claim 12, wherein the rack comprises an aligning portion at a rear thereof, the aligning portion being gearless for aligning the pinion.

14. The refrigerator according to claim 12, wherein the rack comprises a flat region of a predetermined length at a rear portion thereof, to dispose the shaft and rack perpendicularly when the storage member is completely inserted.

15. A method for assembly of a refrigerator, comprising:

mounting a fixing member inside a main body of the refrigerator, the fixing member forming a fixing slot with openings at the front and top;

forming a door assembly through coupling a door that opens and closes a storage space to a rail member enabling the door to be withdrawn and inserted;

mounting the door assembly inside the storage space through downwardly inserting a mounting bracket at a side of the rail member into the fixing slot; and mounting a cover member on the rail member, the cover member having a portion disposed in a space between the main body and the rail member to prevent the rail member from being exposed at the side.

16. The method according to claim 15, wherein the mounting of the door assembly comprises inserting the mounting bracket supporting the rail member from below into the fixing slot.

17. The method according to claim 15, wherein the forming of the door assembly comprises mounting an anti-wobble member to the rail member and the fixing member, the anti-wobble member enabling uniform withdrawal and insertion of the door.

18. The method according to claim 15, wherein the mounting of the fixing member comprises coupling a rack to a side of the fixing member, the forming of the door assembly comprises coupling a pinion to a side of the rail member, and the mounting of the door assembly comprises coupling the rack and the pinion through gears.

19. The method according to claim 18, wherein the forming of the door assembly further comprises:

providing a second rail member;

coupling a second pinion to the second rail member;

installing a shaft to connect the pinions provided at the rail members; and mounting a storage member to a side of one of the rail members, such that the storage member is enabled to be withdrawn and inserted together with the door.

* * * * *